US008056481B2

(12) United States Patent
Dindl et al.

(10) Patent No.: US 8,056,481 B2
(45) Date of Patent: Nov. 15, 2011

(54) CONTROLLED DECELERATION PROJECTILE

(76) Inventors: Frank J. Dindl, Newton, NJ (US); Kenneth R. Jones, Wayne, NJ (US); Christofer J. Strianse, Pompton Plains, NJ (US)

( * ) Notice: Subject to any disclaimer, the term of this patent is extended or adjusted under 35 U.S.C. 154(b) by 213 days.

(21) Appl. No.: 12/434,793

(22) Filed: May 4, 2009

(65) Prior Publication Data

US 2011/0252995 A1 Oct. 20, 2011

Related U.S. Application Data

(63) Continuation-in-part of application No. 11/717,964, filed on Mar. 14, 2007, now abandoned.

(51) Int. Cl.
*F42B 12/36* (2006.01)

(52) U.S. Cl. ..... 102/502

(58) Field of Classification Search ..... 102/502, 102/506, 508, 513, 529, 505
See application file for complete search history.

(56) References Cited

U.S. PATENT DOCUMENTS 1,042,176 A * 10/1912 Voeller ..... 102/494
4,294,172 A * 10/1981 Rauschert et al. ..... 102/473
4,333,402 A * 6/1982 Landstrom et al. ..... 102/505
4,446,794 A * 5/1984 Simmons ..... 102/513
4,892,038 A * 1/1990 Lubbers ..... 102/439
6,523,478 B1 * 2/2003 Gonzalez et al. ..... 102/485
6,688,032 B1 * 2/2004 Gonzalez et al. ..... 42/105

* cited by examiner

*Primary Examiner* — Bret Hayes
(74) *Attorney, Agent, or Firm* — Townsend and Banta

(57) ABSTRACT

The present invention provides a controlled deceleration projectile, in particular, a projectile having a nose-mounted fuze thereon, which initiates an ignition/expulsion charge via an ignition shaft in the interior portion of the projectile body at a preset distance from target impact, resulting in inflation of the projectile body with propellant gases to a level sufficient to either expand same, rupturing of a rupture ring, or sliding of the hollow projectile body rearwards relative to the ignition shaft, so as to create an annular opening between the projectile body side wall and projectile body forward end. The payload, which is preferably non-lethal, is then ejected from this annular opening, the resulting forward velocity of the expelled payload and propellant gases producing a rearward thrust on the projectile, and a concomitant deceleration thereof. Additional mechanisms for creating reverse thrust are also provided, involving the expulsion of rear ballast or rocket thrust from rear chamber ports disposed within the projectile.

7 Claims, 16 Drawing Sheets

CONTROLLED DECELERATION PROJECTILE

This application is a continuation-in-part application of pending U.S. patent application Ser. No. 11/717,964, filed Mar. 14, 2007, the contents of which are incorporated herein by reference.

FIELD OF THE INVENTION

The present invention relates in general to a controlled deceleration projectile. In particular, the present invention provides a projectile, having a nose-mounted fuze thereon, which initiates an ignition charge via an ignition shaft disposed within the projectile body at a preset distance from target impact, resulting in inflation of the projectile body with propellant gases to a level sufficient to either expand same, rupture a rupture ring, or slide the hollow projectile body rearwards relative to the ignition shaft, so as to create an annular opening between the projectile body side wall and projectile body forward end. The payload, which is preferably non-lethal, is then ejected from this annular opening, the resulting forward velocity of the expelled payload and propellant gases producing a rearward thrust on the projectile, and a concomitant deceleration thereof.

BACKGROUND OF THE INVENTION

Conventional non-lethal ammunition is launched with a kinetic energy sufficiently low to effect a non-lethal result upon target impact. To enable launching of ammunition at such reduced velocities (and hence with reduced kinetic energies), it is necessary to reduce the muzzle velocity. However, when utilizing non-lethal munitions, such as grenades, there is a danger that, even with reduced muzzle velocities, the projectile body itself may have sufficient kinetic energy to severely wound or damage a human target upon impact.

Further, when utilizing non-lethal munitions, such as non-lethal grenades, against inanimate targets, such as automotive windshields, etc., there is a danger that the projectile body will have sufficient kinetic energy upon impact to penetrate the target and harm surrounding human assets. Further, by reducing muzzle velocity, recoil impulse is also reduced, which frequently causes malfunctioning of the weapon operating system and fire control when firing the non-lethal ammunition from standard weapons. In addition, conventional non-lethal munitions are not range specific, i.e., they are meant to be used for targets within a wide range from the shooter, and are not tailored to targets within specific ranges.

Frequently, such conventional non-lethal munitions fail to reach reduced velocities (and thus reduced kinetic energies) before impacting the target, when the target is at a close proximity from the shooter, or are incapable of reaching targets at longer ranges, due to reduced velocities/kinetic energies at such longer ranges. Thus, many conventional non-lethal munitions are provided with detailed guidelines concerning target ranges, to minimize the occurrence of lethal impact or ineffectiveness. However, in combat situations, adherence to such guidelines is difficult and often overlooked.

Thus, it is an object of the present invention to provide a munition capable of providing recoil impulse sufficient to cycle standard weapons, while also providing optimized non-lethal effects at all target ranges. In particular, it is an object of the present invention to provide a munition capable of achieving sufficient recoil impulse and kinetic energy to reach desired targets, while also being able to reduce the velocity of the projectile body to a non-lethal level before impact with the target, or be capable of decelerating the projectile body before impact with the target to avoid impact of the projectile body with the target altogether.

SUMMARY OF THE INVENTION

In order to achieve the object of the present invention, the present inventors earnestly endeavored to provide a projectile having a projectile body capable of expelling a payload therein before impact, and decelerating the projectile body to a non-lethal velocity before impact with the target. Accordingly, the present inventors developed a controlled deceleration projectile having an expellable payload therein. In particular, in a first embodiment of the present invention, a controlled deceleration projectile is provided comprising:

(a) a hollow projectile body having a rear end, a circumferential portion adjacent the rear end defining an interior portion, and a front edge opposite the rear end defined by the circumferential portion;

(b) an interior portion of the hollow projectile body defined by the circumferential portion and rear end of the hollow projectile body, said interior portion capable of containing a payload;

(c) a hollow ignition shaft disposed within the interior portion of the hollow projectile body, the hollow ignition shaft having a first end with an angled exhaust surface formed contiguous there with adjacent the front edge of the hollow projectile body, a second end opposite the first end, a hollow middle portion there between having ignition ports disposed there through, and ignition propellant disposed within the hollow middle portion;

(d) ignition propellant disposed within the interior portion of the hollow projectile body, at least adjacent to the ignitions ports of the hollow ignition shaft;

(e) a payload disposed within the interior portion; and (c) a nose-mounted fuze disposed adjacent the front edge of the hollow projectile body, and in communication with the ignition propellant disposed within the hollow ignition shaft, said nose-mounted fuze having a means for initiating the ignition propellant.

In a second embodiment of the present invention, the controlled deceleration projectile of the first embodiment is provided, wherein the projectile body is comprised of aluminum, copper, brass or steel.

In a third embodiment of the present invention, the controlled deceleration projectile of the first embodiment is provided, wherein the annular opening is from about 0.005 to 0.050 inches in diameter.

In a fourth embodiment of the present invention, the controlled deceleration projectile of the first embodiment is provided, wherein the circumferential portion of the hollow projectile body has a thickness of between about 0.030 and 0.125 inches.

In a fifth embodiment of the present invention, the controlled deceleration projectile of the first embodiment is provided, wherein the hollow projectile body expands from about 0.010 to about 0.100 inches in diameter at the front edge thereof after ignition of the expulsion propellant.

In a sixth embodiment, the controlled deceleration projectile of the first embodiment above is provided, wherein the nose-mounted fuze is a point-detonating fuze or a proximity fuze.

In a seventh embodiment of the present invention, the controlled deceleration projectile of the first embodiment above is provided, further comprising a ballast material disposed within the interior portion of the hollow projectile body.

In an eighth embodiment of the present invention, the controlled deceleration projectile of the seventh embodiment above is provided, wherein the ballast material is a dense powder, such as a metal powder. For example, tungsten or iron powder may be utilized.

In a ninth embodiment of the present invention, the controlled deceleration projectile of the first embodiment is provided, wherein the thickness of the circumferential portion of the hollow projectile body tapers towards to the front end thereof. This structural aspect enables the circumferential portion to deform (i.e., expand or "burp") at the front edge thereof.

In a tenth embodiment of the present invention, the controlled deceleration projectile of the first embodiment above is provided, wherein the payload is a non-lethal payload. For example, the payload may be a ballast material, a pyrotechnic flash-bang composition, or a crowd control agent such as tear gas, etc.

In an eleventh embodiment of the present invention, the controlled deceleration projectile of the first embodiment above is provided, further comprising a rupture ring disposed between the front edge of the hollow projectile body and the nose mounted fuze or first end of the hollow ignition shaft. In such an embodiment, the rupture ring is provided as an alternative to a deformable hollow projectile body, wherein the rupture ring is designed to rupture at a predetermined pressure. Accordingly, the rupture ring may be formed of any material capable of failing at a set pressure, such as polymeric materials, plastics, thinly formed metals, etc.

In a twelfth embodiment of the present invention, the controlled deceleration projectile of the first embodiment of the present invention is provided, further comprising a check valve disposed between the nose mounted fuze and the first end of the hollow ignition shaft. This check valve allows the ignition of the ignition propellant within the hollow ignition shaft by the nose-mounted fuze, but prevents ignited propellant and gasses resulting therefrom from flowing towards the nose-mounted fuze. Rather, the propellant gases are directed rearwards, and through the ignition ports.

In a thirteenth embodiment of the present invention, the controlled deceleration projectile of the first embodiment above is provided, further comprising:

(i) expulsion propellant disposed within the interior portion of the hollow projectile body, adjacent the ignition ports of the hollow ignition shaft; and (ii) one or more partitions disposed within the interior portion of the hollow projectile body, wherein the partition(s) act to physically separate the expulsion propellant from the payload.

In a fourteenth embodiment of the present invention, the controlled deceleration projectile of the first embodiment above is provided, further comprising a tethering means having a first end in connection with the nose-mounted fuze, and a second end in connection with the hollow projectile body. This tethering means, which is preferably a string or line, allows the hollow projectile body and nose mounted fuze to directly detach from one another after firing, but remain connected so as to provide an additional means of deceleration.

In a fourteenth embodiment of the present invention, the controlled deceleration projectile of the thirteenth embodiment above is provided, wherein the nose-mounted fuze is tethered to the hollow projectile body via a string or line in connection at a first end thereof with the hollow projectile body, and at a second end thereof with the nose-mounted fuze.

In a fifteenth embodiment of the present invention, the controlled deceleration projectile of the eleventh embodiment above is provided, further comprising:

(i) a rear chamber disposed within the hollow projectile body between the rear end of the hollow projectile body and the second end of the hollow ignition shaft;

(ii) a rear chamber port disposed within the hollow projectile body between the rear chamber and the second end of the hollow ignition shaft, so as to connect the hollow ignition shaft to the rear chamber;

(iii) two or more rear chamber exhaust ports, each of said exhaust ports being hollow, and extending from the rear chamber to the circumferential portion of the projectile, thereby providing a means of egress from the rear chamber to the exterior of the projectile.

In a sixteenth embodiment of the present invention, the controlled deceleration projectile of the fifteenth embodiment above is provided, further comprising:

(i) a check valve disposed within or adjacent to the rear chamber port.

In a seventeenth embodiment of the present invention, the controlled deceleration projectile of the fifteenth embodiment above is provided, further comprising:

(i) ballast propellant disposed within the rear chamber;

(ii) rear ballast disposed in each of said rear chamber exhaust ports; and (ii) a rear piston disposed in each of said rear chamber exhaust ports, between the rear ballast and the rear chamber.

In an eighteenth embodiment of the present invention, the controlled deceleration projectile of the fifteenth embodiment above is provided, further comprising:

(i) solid rocket propellant disposed within the rear chamber.

In a nineteenth embodiment of the present invention, a controlled deceleration projectile is provided comprising:

(a) a hollow projectile body having a rear end, a circumferential portion adjacent the rear end defining an interior portion, and a front edge opposite the rear end defined by the circumferential portion;

(b) an interior portion of the hollow projectile body defined by the circumferential portion and rear end of the hollow projectile body, said interior portion capable of containing a payload;

(c) a hollow ignition shaft disposed within the interior portion of the hollow projectile body, the hollow ignition shaft having a first end with an angled exhaust surface formed contiguous there with adjacent the front edge of the hollow projectile body, a second end opposite the first end having a body stop (i.e., a projection extending therefrom) formed therein, a hollow middle portion there between having ignition ports disposed there through, and ignition propellant disposed within the hollow middle portion;

(d) a shear ring disposed between the hollow projectile body and hollow ignition shaft, so as to rigidly secure the hollow projectile body to the hollow ignition shaft;

(e) a payload disposed within the interior portion; and (c) a nose-mounted fuze disposed adjacent the front edge of the hollow projectile body, and in communication with the ignition propellant disposed within the hollow ignition shaft, said nose-mounted fuze having a means for initiating the ignition propellant.

In the above embodiment, the shear ring is formed of a material designed to fail (i.e., break, crack, etc.) at a certain pressure or force. Upon failure of the shear ring, the hollow projectile body is free to slide rearward relative to the hollow ignition shaft, until reaching the body stop. Accordingly, there is no need to deform the hollow projectile body to provide an expulsion point for the payload.

When the controlled deceleration projectile of the present invention is fired, the nose-mounted fuze ignites the ignition propellant when the projectile travels to within a preset distance from a target, causing the ignition propellant to form propellant gases within the interior portion thereof. These propellant gases thereby create high pressure within the interior portion of the hollow projectile body. In one embodiment, this high pressure causes expansion of the hollow projectile body at least at and adjacent to the front edge thereof sufficient to create an annular opening between the front edge of the projectile body and the nose-mounted fuze.

In one alternative embodiment, the high pressure within the interior portion causes rupturing of a rupture ring, thereby forming an annular opening at the point of the rupture ring. In another alternative embodiment, the high pressure induced by the propellant gases causes shearing of a shear ring holding the hollow projectile body to the hollow ignition shaft, allowing the projectile body to slide rearwards, thereby creating an annular opening adjacent the front edge of the projectile body. In each embodiment, the payload, as well as the propellant gases, is then expelled through the annular opening, causing deceleration of the hollow projectile body by the reverse thrust created by the propellant gases and payload.

In a further alternative embodiment, as described above in the sixteenth through eighteenth embodiments above, further means of reverse thrust are provided. In particular, in one embodiment, ballast is expelled from rear chamber exhaust ports by the ignition of ballast propellant disposed within a rear chamber. This ballast propellant is initiated by the ignition propellant, thereby eliminating the need for an additional source of initiation. In an alternative embodiment, rather than expelling ballast, solid rocket propellant is disposed within the rear chamber, and when initiated by the ignition propellant disposed within the hollow ignition shaft, a reverse thrust is provided via the rear chamber exhaust ports by the expulsion of hot solid rocket propellant gases there from.

DETAILED DESCRIPTION OF THE INVENTION

Figure 1:
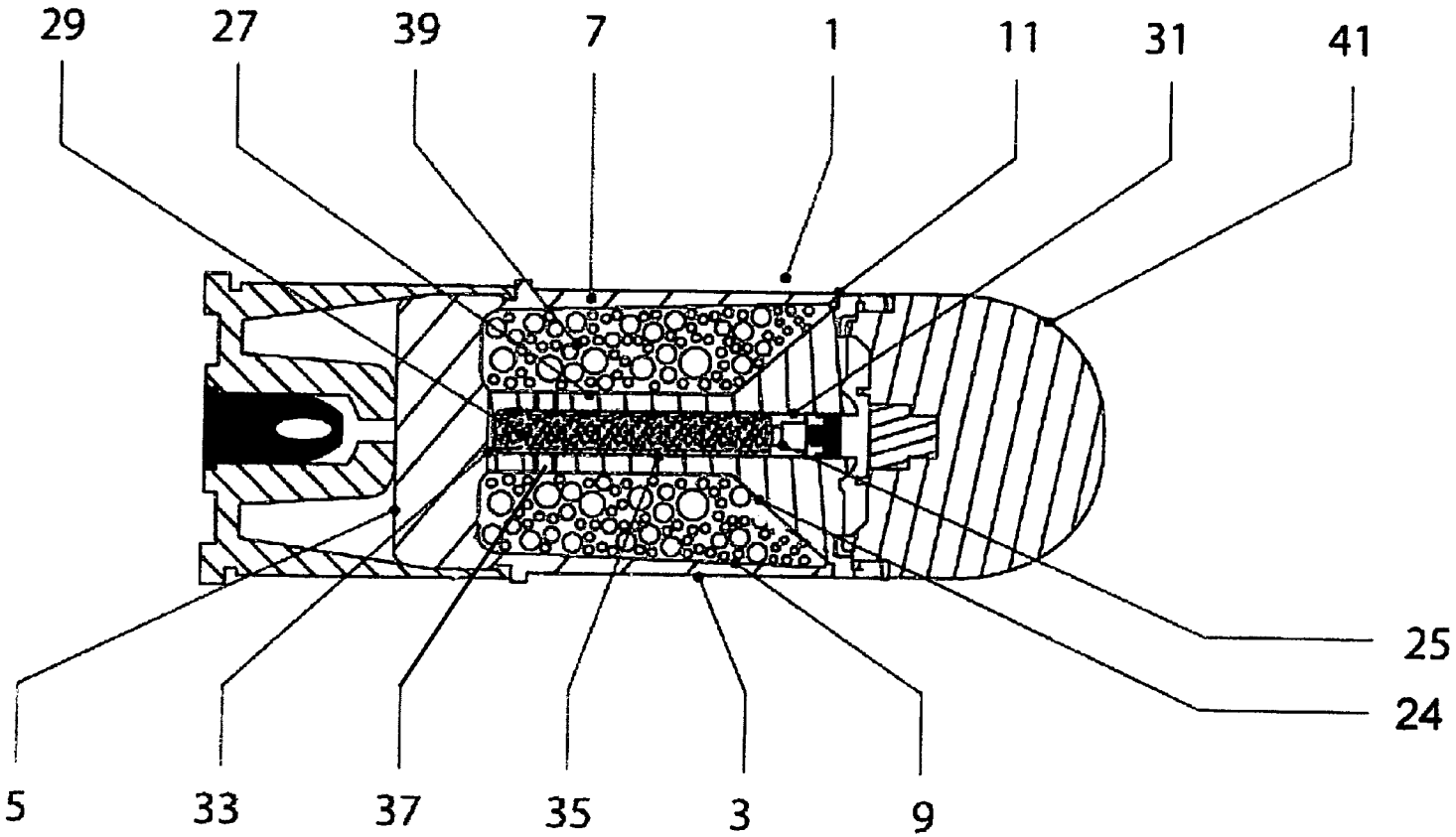
FIG. 1 is a cross sectional view of a grenade, containing the non-lethal projectile of the present invention.
Figure 2:
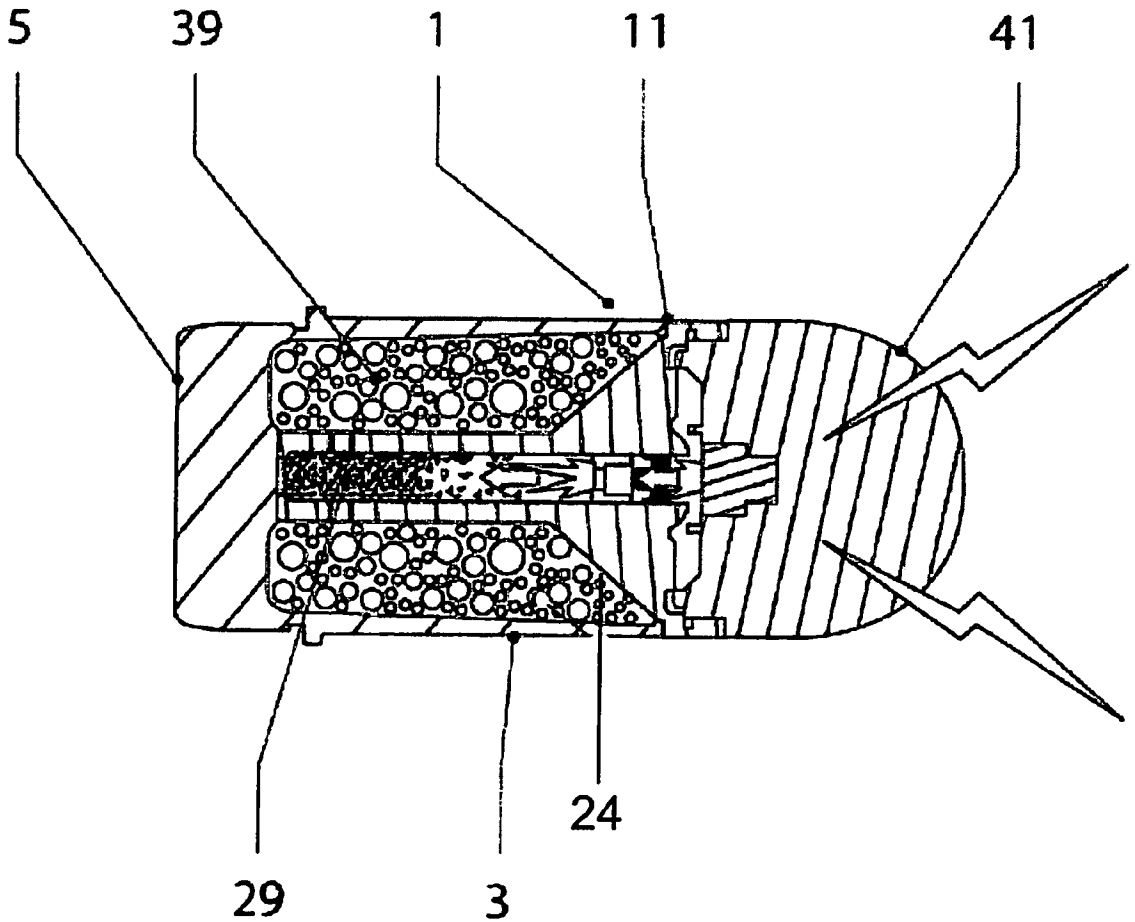
FIG. 2 is a cross sectional view of the non-lethal projectile of the present invention after firing of the grenade shown in FIG. 1, illustrating the projectile at a point in time when the nose-mounted fuze has begun to initiate the expelling charge, but before the projectile body has "burped" and expelled the non-lethal payload.

As illustrated in FIG. 1 herein, the present invention provides a projectile 1, shown as part of a grenade before firing thereof. The projectile 1 is comprised of a hollow projectile body 3 having a rear end 5, a circumferential portion 7 adjacent the rear end 5 defining an interior portion 9, and a front edge 11 opposite the rear end 5 defined by the circumferential portion 7. The hollow projectile body 3 is formed of metals or polymers that are able to slightly expand without extreme fragmentation thereof upon exposure to high pressures and temperatures. Generally, aluminum, copper, brass or steel are used, with aluminum being the most preferred material, based on ease of manufacture, high strength to weight ratio, sufficient elongation properties and, in flash-bang applications, the contribution of the aluminum to the flash-bang reaction.

Figure 3:
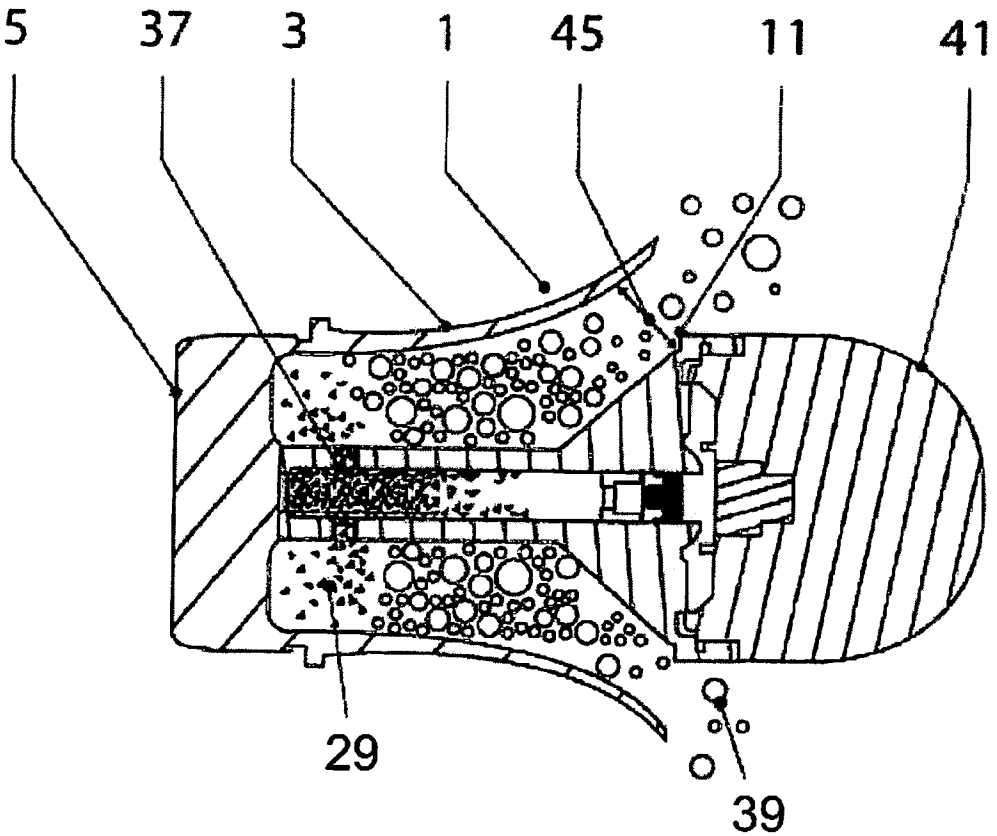
FIG. 3 is a cross sectional view of the non-lethal projectile of the present invention, illustrating the projectile at a point in time after firing, wherein the nose-mounted fuze has initiated the expelling charge, the projectile body has "burped", and the non-lethal payload has begun to be expelled from the hollow projectile body.
Figure 4:
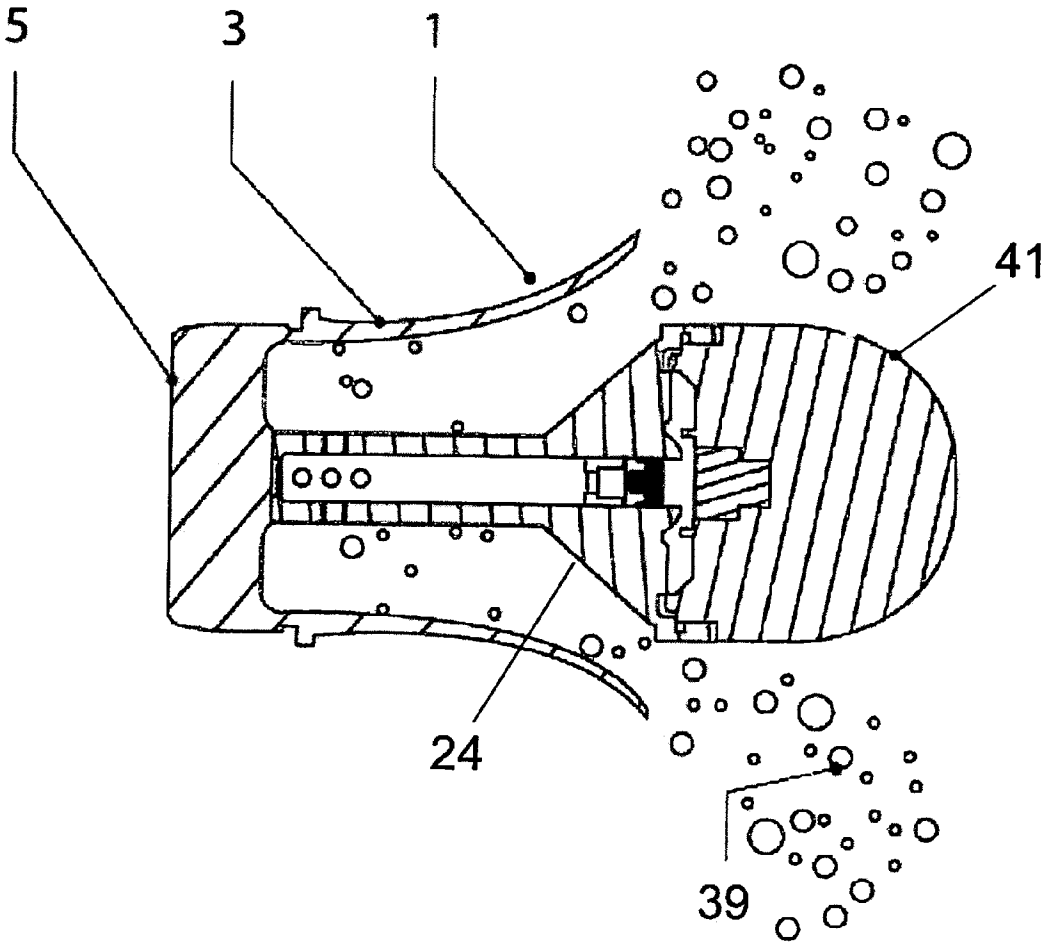
FIG. 4 is a cross sectional view of the non-lethal projectile of the present invention, illustrating the projectile at a point in time after the nose-mounted fuze has initiated the expelling charge, the projectile body has "burped", the non-lethal payload has been expelled from the hollow projectile body, and the expulsion of the non-lethal payload and expulsion charge propellant gases has decelerated the hollow projectile body and nose-mounted fuze.

It has been found that the optimum thickness of the circumferential portion 7 of the hollow projectile body 3, when formed of aluminum, for enabling proper expansion thereof during firing, is between about 0.030 and 0.125 inches. This circumferential portion 7 thickness allows the hollow projectile body 3 to expand from about 0.010 to about 0.40 inches in diameter at the front edge 11 thereof after ignition of the expulsion propellant 38. In an alternative embodiment, the thickness of the circumferential portion 7 may be tapered toward the front edge 11 of the hollow projectile body 3, which may be desired in some applications to tailor the size of the annular opening 45 created between the front edge 11 and nose-mounted fuze 41 upon ignition of the expulsion propellant 38, as illustrated in FIG. 3.

The hollow ignition shaft 27, which contains ignition propellant 29, is disposed within the interior portion 9, and has a first end 31 adjacent the ignition shaft port 25. A second end 33 of the hollow ignition shaft 27 is disposed opposite the first end 31, and a hollow middle portion 35 is disposed there between. Ignition ports 37 are disposed through said hollow middle portion 35. As illustrated in FIG. 1, the hollow projectile body 3 serves to contain the payload 39, which is preferably a non-lethal powdered payload/pyrotechnic, but may also be lethal if desired.

During testing, it was found that the payload 39 was frequently expelled in an uneven and uncontrolled manner, causing the projectile to decelerate in unexpected ways. For example, the majority of the payload 39 was sometimes expelled from one side of the projectile 1, causing the projectile to be forced in a direction relatively perpendicular to its flight path. In other instances, the payload 39 was observed to shoot straight outwards from the annular opening 45, rather than towards the target as desired. The present inventors unexpectedly discovered that integrating an angled exhaust surface 24 into to the hollow ignition shaft 27 directed the payload 39 towards the target upon expulsion from the projectile as desired. Further, this directed expulsion of the payload 39 was found to contribute to a more controlled expulsion, and hence a more controlled deceleration of the projectile 1.

In certain embodiments, such as illustrated in FIGS. 7, 8, 9 and 12, expulsion propellant 38 is disposed within the interior payload cup cavity 19, adjacent to the ignitions ports 37 of the hollow ignition shaft 27. Preferably, in such embodiments, preferably, as illustrated in FIGS. 7, 8, 9 and 12, a partition 4 is disposed within the hollow projectile body 3, to separate the powdered payload or pyrotechnic payload 39 from the expulsion propellant 38. The partition 4 or a payload cup 51 as shown on FIG. 12, serves to both physically separate these components, as well as provide a piston-like apparatus to assist in the expulsion of the payload 39 from the interior payload cup cavity 19.

A nose-mounted fuze 41, which may be a proximity fuze or point-detonation fuze, is disposed adjacent the front edge 11 of the hollow projectile body 3, and is in communication with the ignition propellant 29 disposed within the hollow ignition shaft 27, so as to be able to ignite/initiate same. Thus, the nose-mounted fuze 41 has a conventional means for initiating the ignition propellant 29, such as a primer assembly, electrical initiation means, etc.

Further, as mentioned above, also contained within the interior payload cup cavity 19 is the payload 39, which generally is a powder or aggregate material, or a pyrotechnic, but is not limited thereto. Preferably, the payload is a non-lethal payload, including for example a dense powder, such as a metal powder, but may be any powder that is non-lethal upon impact with the target. Alternatively, the non-lethal payload may be comprised of a pyrotechnic flash-bang material, a riot control agent, or a marking dye. In addition, the interior payload cup cavity 19 may further comprise a ballast material, such as a dense powder, or the payload 39 may act itself as the ballast material.

Figure 12:
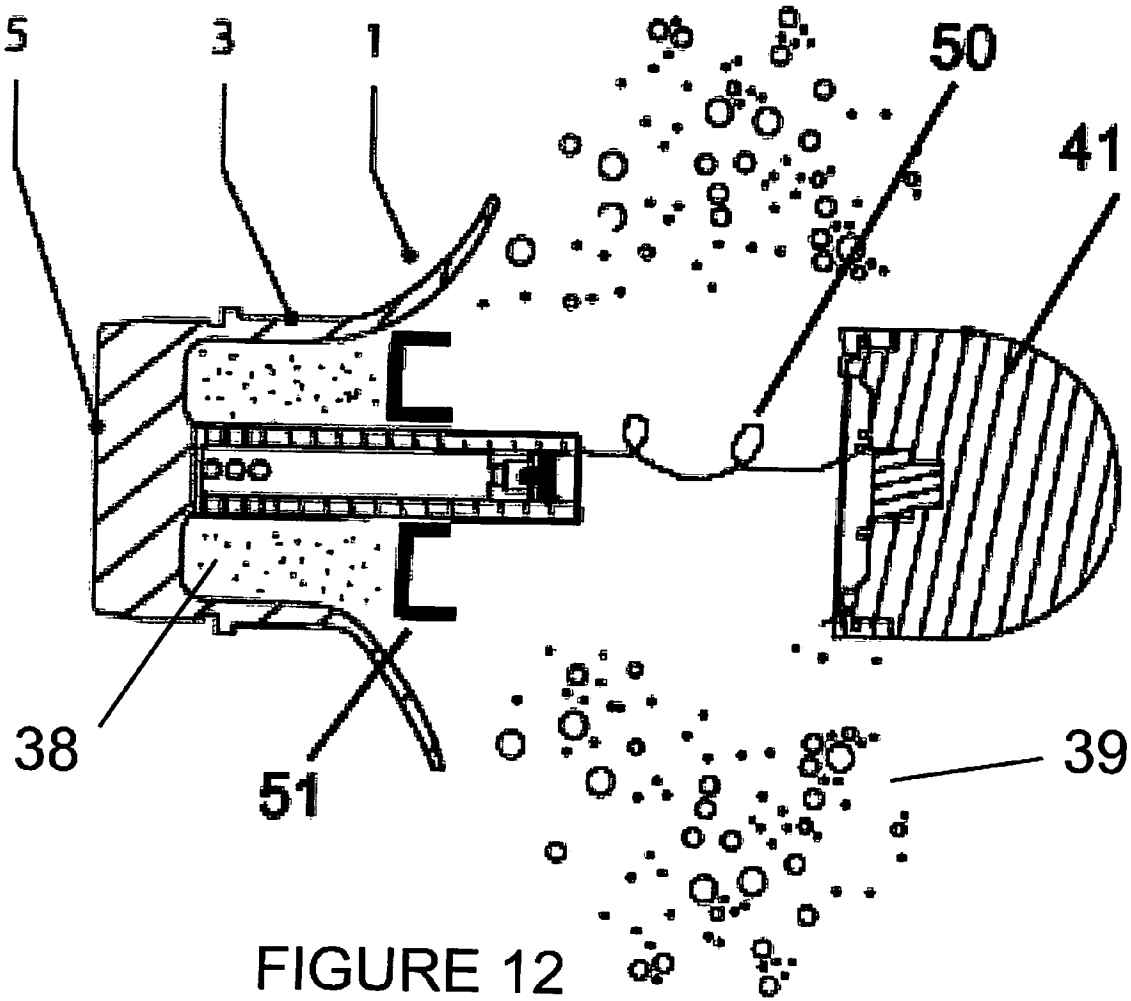
FIG. 12 is a cross sectional view of the projectile of the present invention, wherein a payload cup separates the payload from expulsion propellant, and a string or line is provided to attach the nose mounted fuze to the projectile body.

It is preferable that the nose-mounted fuze 41 not impact the target during firing, as the nose-mounted fuze 41 may itself be lethal upon impact. Thus, the nose-mounted fuze 41 is preferably affixed to the hollow projectile body 3, to allow the deceleration process to act upon the nose-mounted fuze 41, as well as the hollow projectile body 3. As an alternative to direct affixation, the nose-mounted fuze 41 may be in connection with the hollow projectile body 3 via a tethering means. For example, as illustrated in FIG. 12, the nose-mounted fuze 41 may be tethered to the hollow projectile body 3 via a string or line 50, in connection at a one end thereof with the hollow projectile body 3, and at a the opposite end thereof with the nose-mounted fuze 41.

As illustrated in FIG. 3, when the ignition propellant 29 is ignited, the ignition travels through the propellant 29, igniting same and expelling propellant gases and unburned propellant through the ignition ports 37, and into the interior portion 9 of the projectile 9. At a certain predetermined pressure, these high temperature propellant gases within the interior 9 of the hollow projectile body 3 cause expansion thereof, i.e., "burping" thereof, adjacent the front edge 11, creating an annular opening 45 between the front edge 11 and nose-mounted fuze 41.

The high internal pressure built up within the internal portion 9 causes the propellant gases to expel the payload 39 through the annular opening 45. This expulsion of pressurized gases, payload 39 and, alternatively, ballast material, creates a reverse thrust on the hollow projectile body 3. This reverse thrust decelerates the hollow projectile body 3, thereby slowing the velocity of the hollow projectile body 3 to a non-lethal velocity upon impact with the target, or more desirable, avoids impact of the hollow projectile body 3 with the target altogether.

During testing, it was found that different materials used to fabricate the hollow projectile body require different amounts of internal pressure to "burp" the projectile. In particular, the pressure needed to adequately expand the hollow projectile body to create a desirable annular opening varies based on material used, and dimensions (such as thickness) of the material. Importantly, after expansion and expulsion of the propellant gases and the non-lethal payload, the internal pressure is rapidly reduced. Thus, undesirable fragmentation of the hollow projectile body is avoided.

Figure 5:
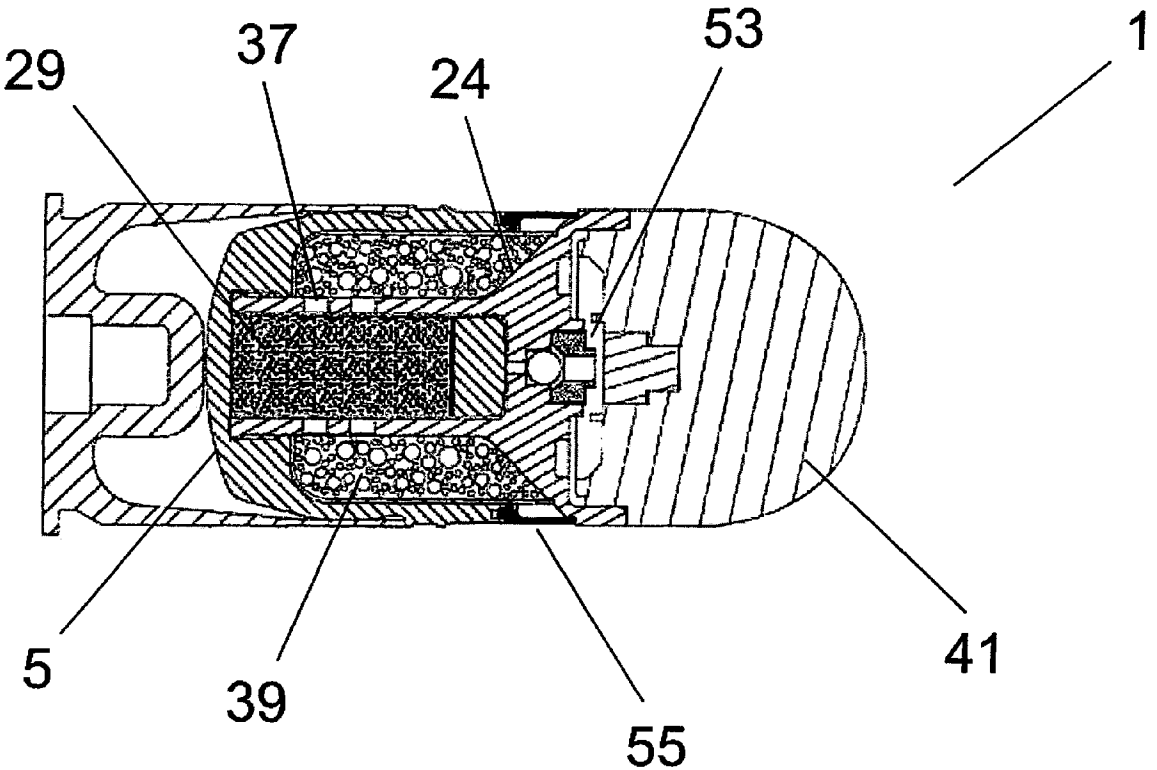
FIG. 5 is a cross sectional view of a grenade containing the non-lethal projectile of the present invention, illustrating the embodiment wherein a rupture ring is provided between the front edge of the projectile body and the nose-mounted fuze, to provide an exit point for the expulsion of the payload.
Figure 6:
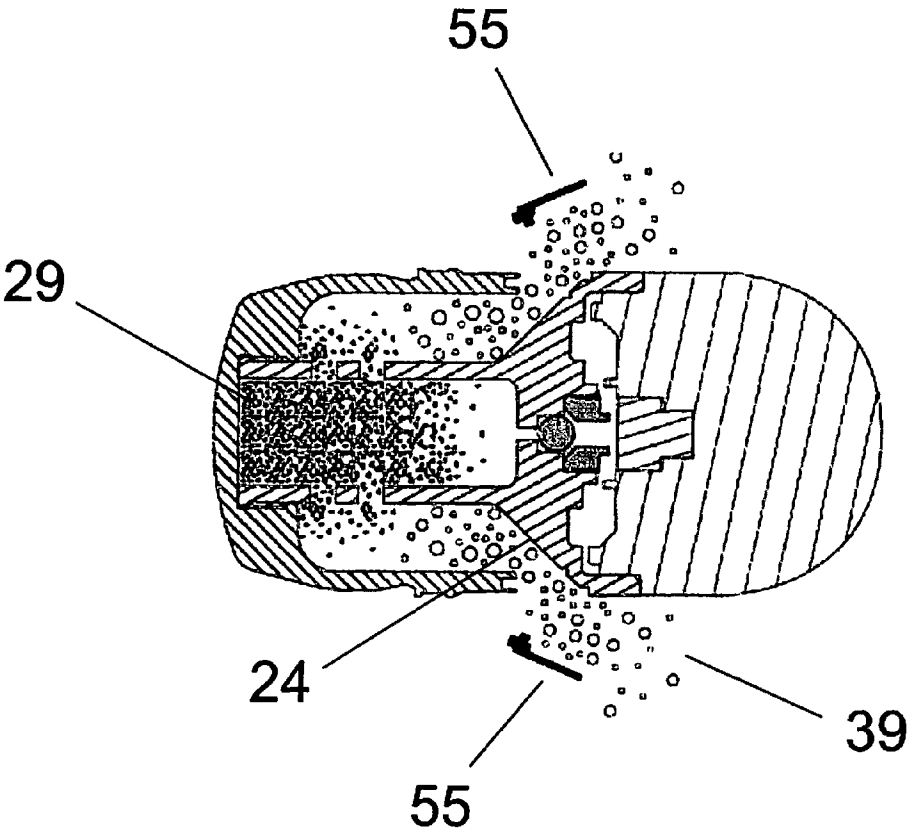
FIG. 6 is a cross sectional view of the projectile of the present invention shown in FIG. 5, after firing thereof, illustrating projectile after the rupture ring has been ruptured by the propellant gases, and the payload has begun to be ejected from the projectile and directed towards the target by the angled exhaust surface.
Figure 7:
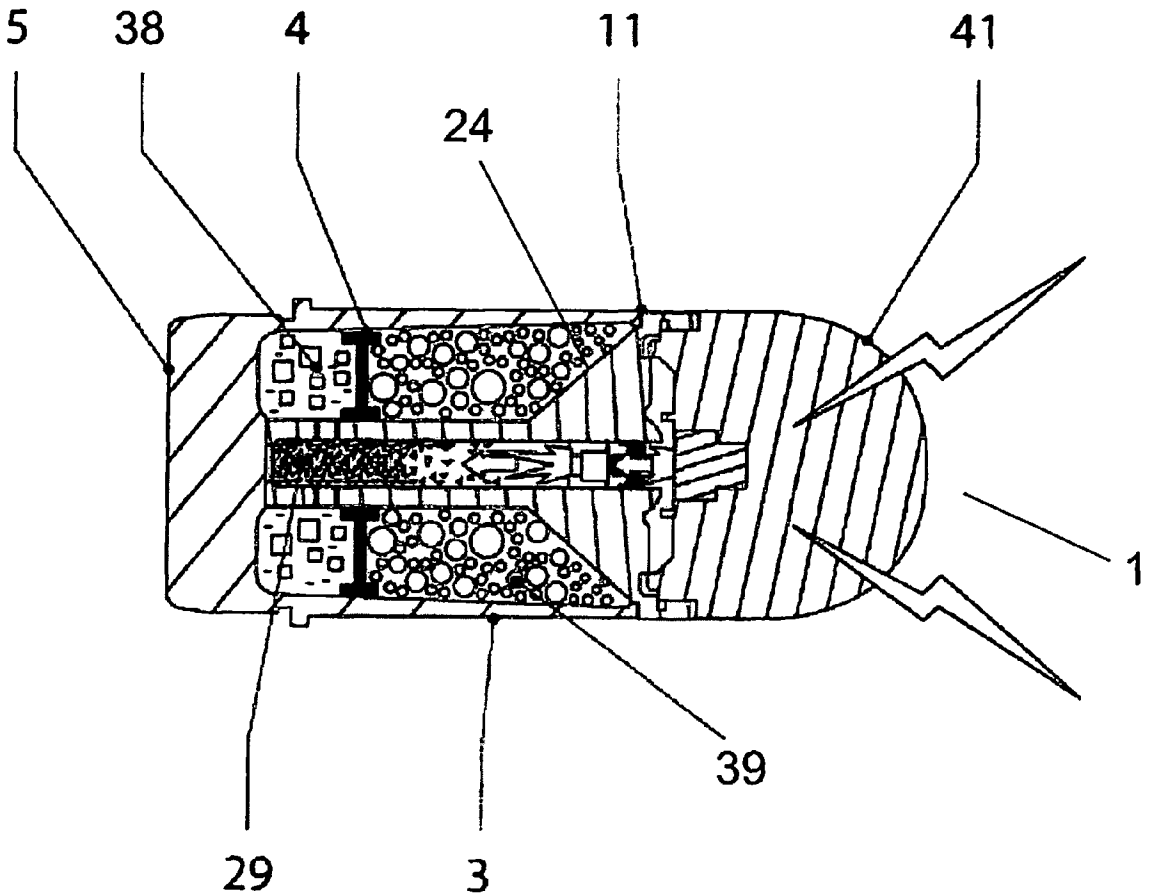
FIG. 7 is a cross sectional view of the projectile of the present invention, illustrating an embodiment wherein a partition is disposed within the hollow projectile body to physically separate the payload from the expulsion propellant.
Figure 8:
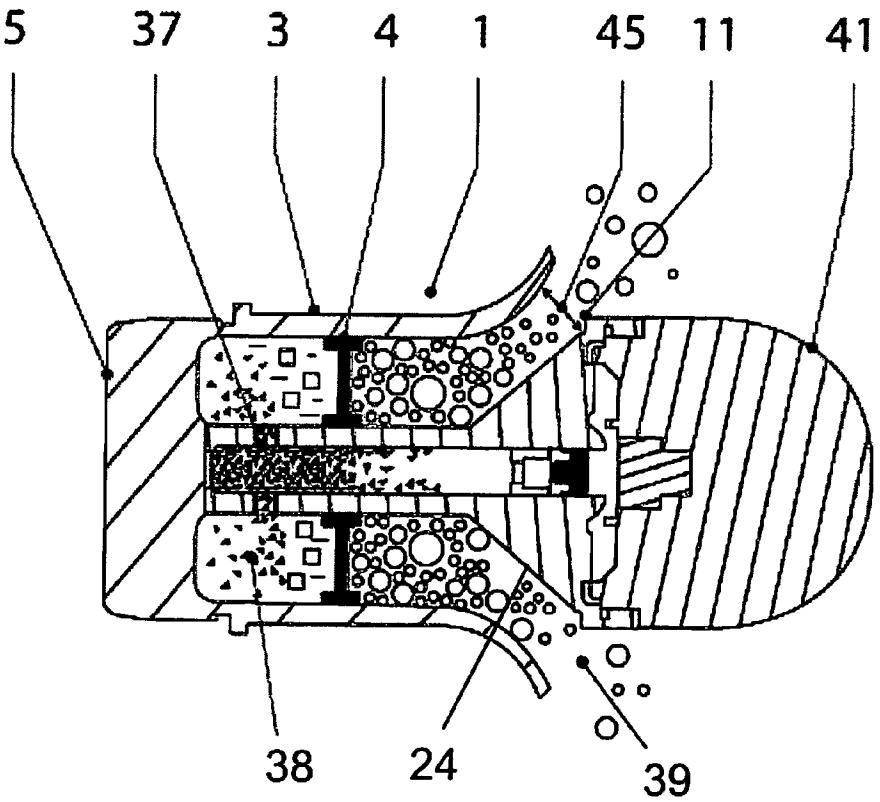
FIG. 8 is a cross sectional view of the projectile of the present invention shown in FIG. 7, after the expulsion propellant has been initiated, thereby driving the partition towards the front of the projectile, so as to begin expelling the payload through the annular opening.
Figure 9:
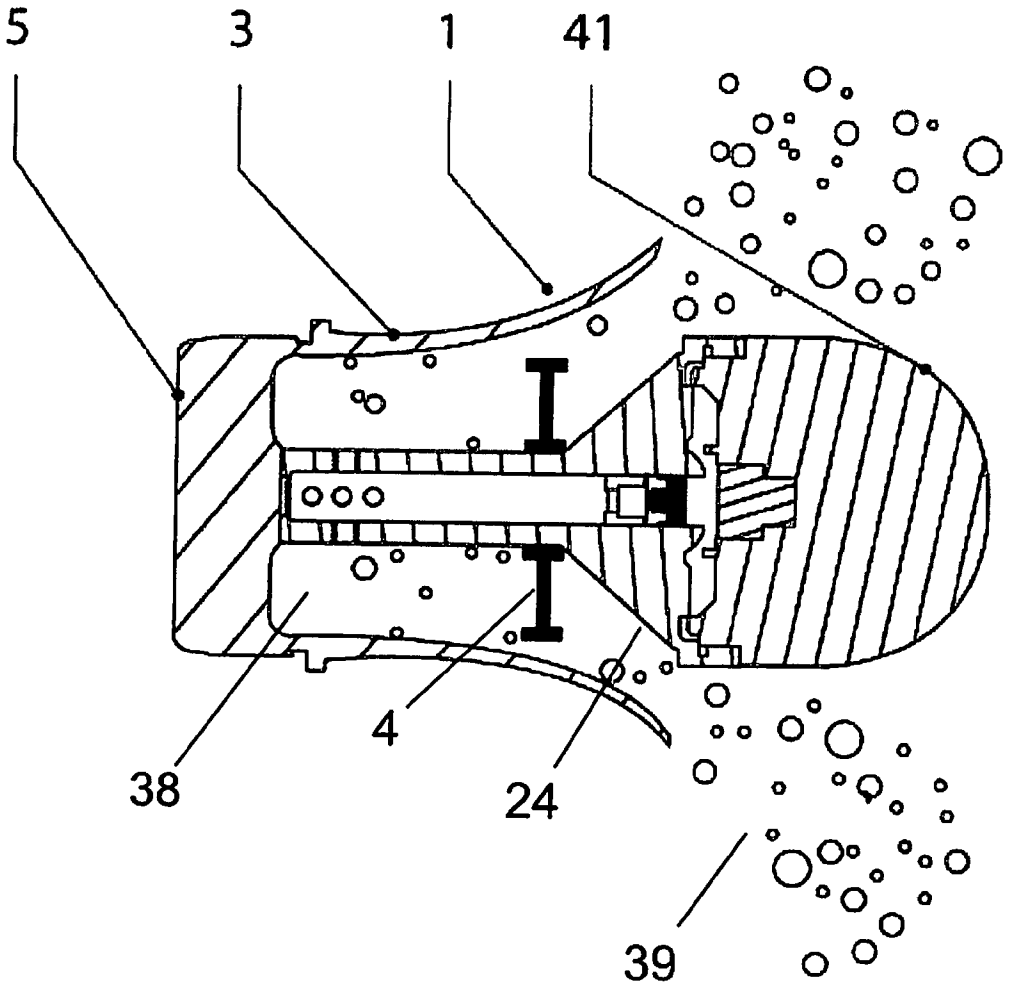
FIG. 9 is a cross sectional view of the projectile of the present invention shown in FIG. 8, wherein the payload has been expelled from the projectile via movement of the partition.

In an alternative embodiment, as illustrated in FIGS. 5 and 6, rather than form the projectile body 3 in such a way as to allow "burping" thereof, a rupture ring 55 is disposed between the front edge 11 of the projectile body 3 and the nose-mounted fuze 41, so as to provide a fixed size exit point for the expulsion of the payload 39. In particular, as illustrate in FIG. 6, after firing, the expanding high temperature propellant gases resulting from the initiation of the ignition propellant 29 rupture the rupture ring 55. The internal pressure then forces the payload 39 to be expelled from the projectile 1, and directed towards the target by the angled exhaust surface 24.

In a further preferred embodiment of the present invention, as illustrated in FIG. 5, a check valve 53 is provided to prevent the propellant gases resulting from the ignited propellant 29 from venting forward. Instead, the check valve acts as a one way valve, enabling only the initiating charge to travel rearward, to ignite the ignition propellant 29. In FIG. 5, a ball-type check valve is shown. However, any conventional configuration of check valve able to withstand high temperatures and pressures may be used to perform this function.

Figure 10:
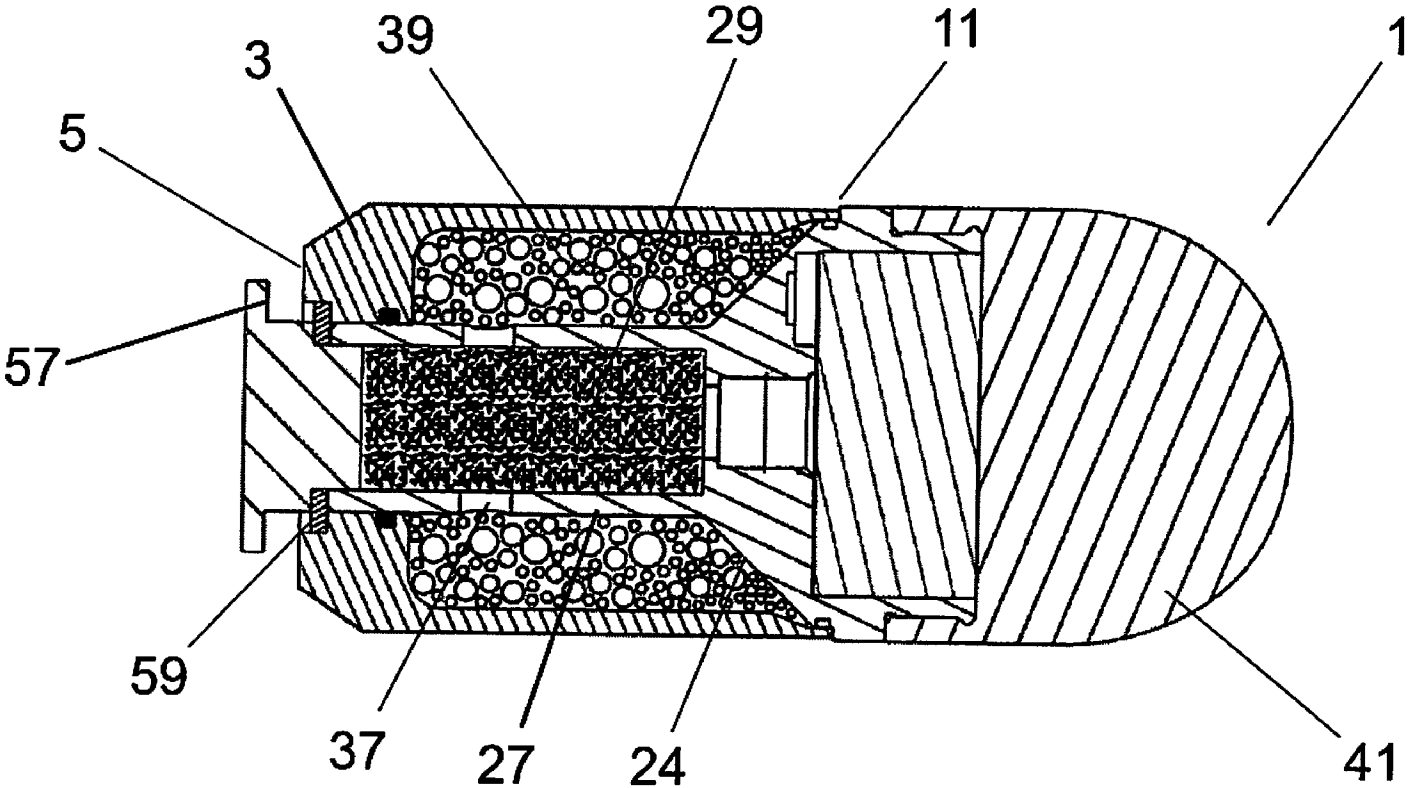
FIG. 10 is a cross sectional view of the projectile of the present invention, illustrating an embodiment thereof wherein initiation of the ignition propellant causes a rapid increase in internal pressure within the projectile body, thereby shearing a shear ring retaining the projectile body in place relative to the hollow ignition shaft, and causing the projectile body to slide rearward relative to the hollow ignition shaft.
Figure 11:
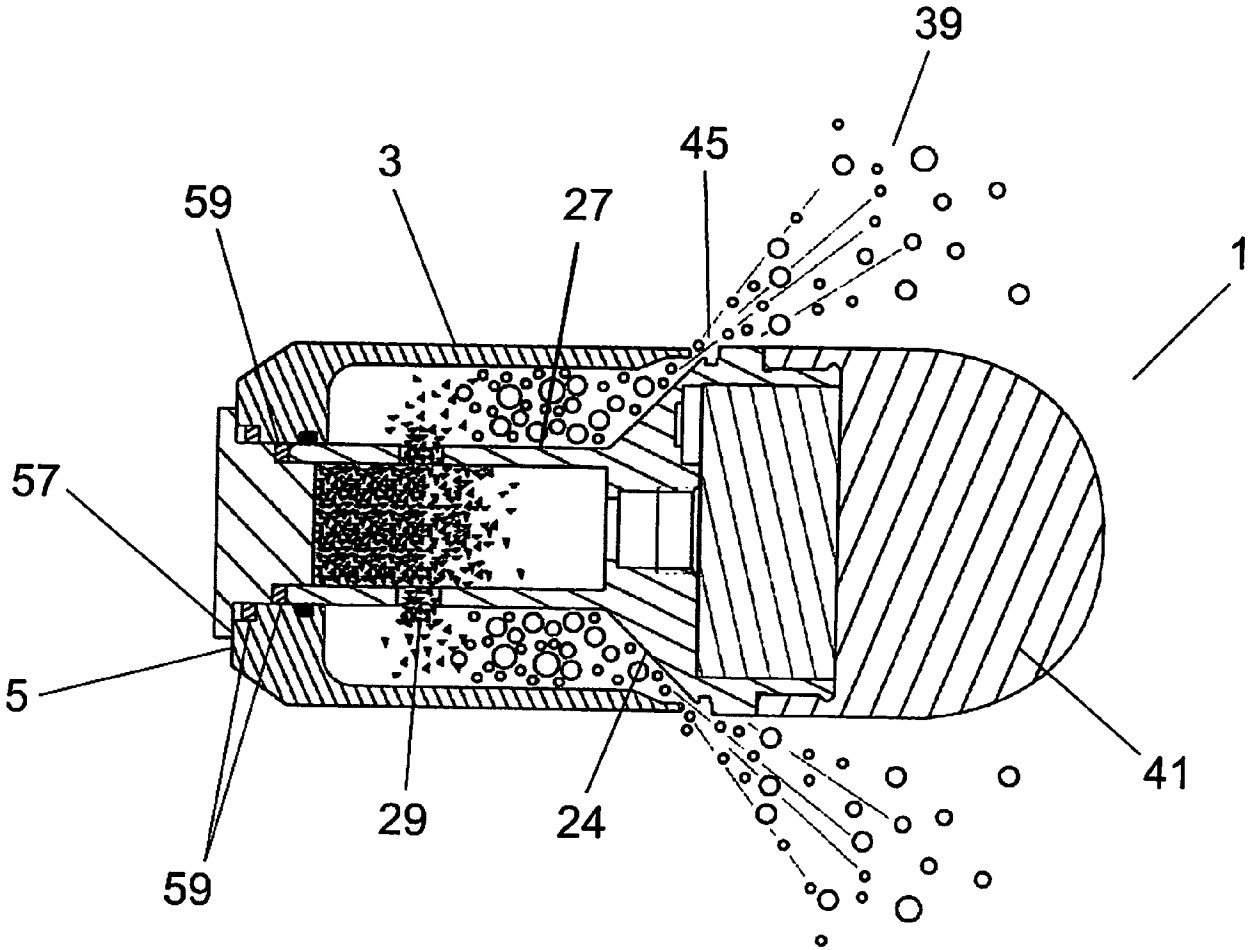
FIG. 11 is a cross sectional view of the projectile shown in FIG. 10, illustrating same after the ignition propellant has been initiated, the shear ring has been broken, and the projectile body has slid rearwards relative to the hollow ignition shaft, thereby creating an annular opening between the projectile body and the nose mounted fuze, allowing the payload to be expelled through the annular opening.

In a further preferred embodiment, instead of providing a deformable hollow projectile body 3 (which can "burp") as illustrated in FIGS. 1-4, 7-9 and 12, or a rupture ring 55, as illustrated in FIGS. 5 and 6, to enable a means of expelling the payload, as illustrated in FIGS. 10 and 11, the hollow projectile body 3 can be configured so as to slide rearward relative to the hollow ignition shaft 27 and nose mounted fuze 41. In particular, the hollow projectile 3 is disposed adjacent the hollow ignition shaft 27, and held in rigid disposition thereto before firing via one or more shear rings 59. These shear rings 59 are designed to fail (crack) at a predetermined pressure.

As illustrated in FIG. 11, when the ignition propellant 29 is initiated, the propellant 29, as well as high temperature propellant gases, is expelled through the ignition ports 37 and into the interior portion 9 of the projectile body 3. At a certain pressure, the shear ring 59 fails, and the pressure then forces the hollow projectile body 3 to slide rearwards relative to the nose mounted fuze 41 and hollow ignition shaft 27, until the hollow projectile body 3 contact the body stop 57. At this point, an annular opening 45 has been created, through which the payload 39 is expelled.

Figure 13:
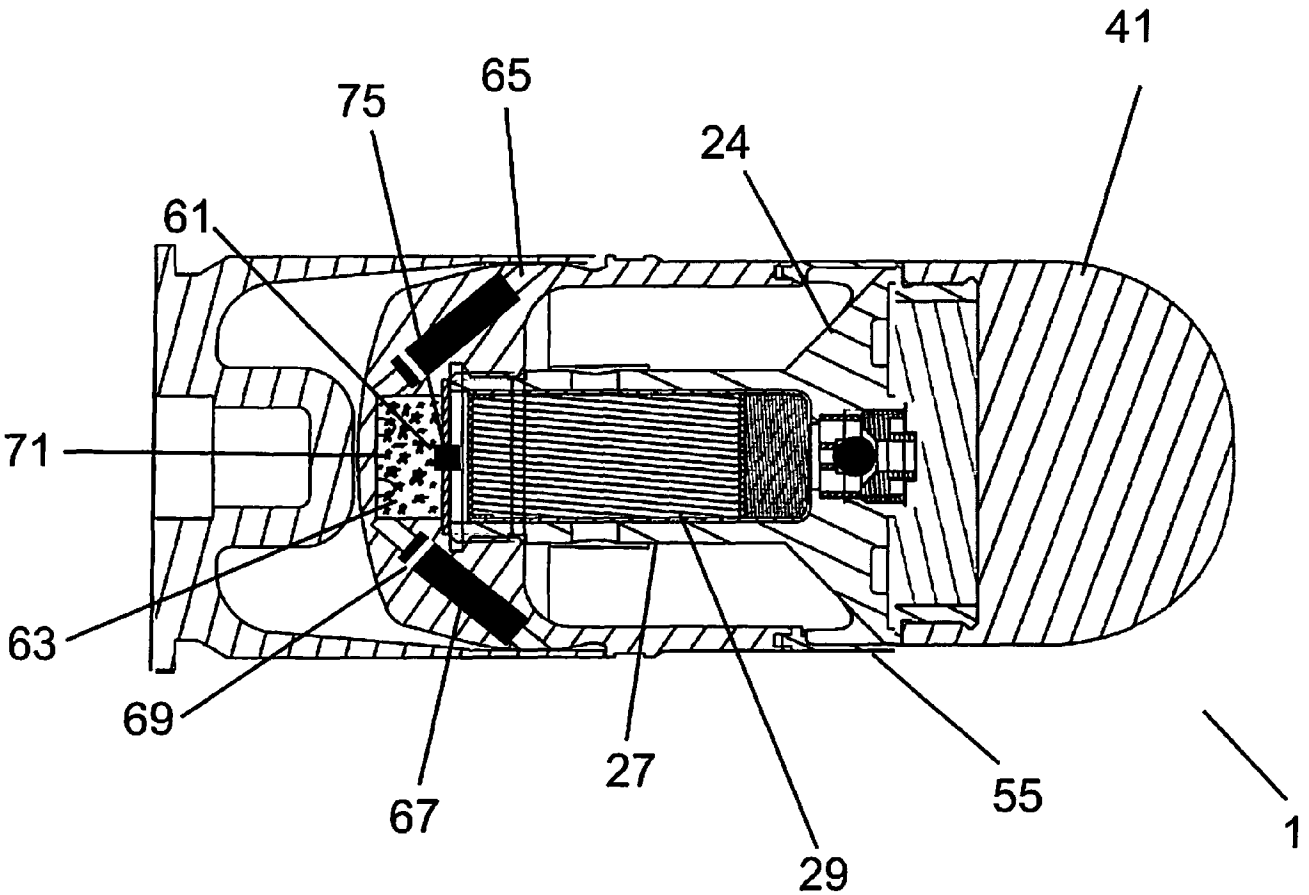
FIG. 13 is a cross sectional view of the projectile of the present invention, wherein a rear ballast is provided which, when forcibly expelled from the projectile by the initiation of a ballast propellant disposed in a rear chamber of the projectile, exerts a reverse impulse to decelerate the projectile.
Figure 14:
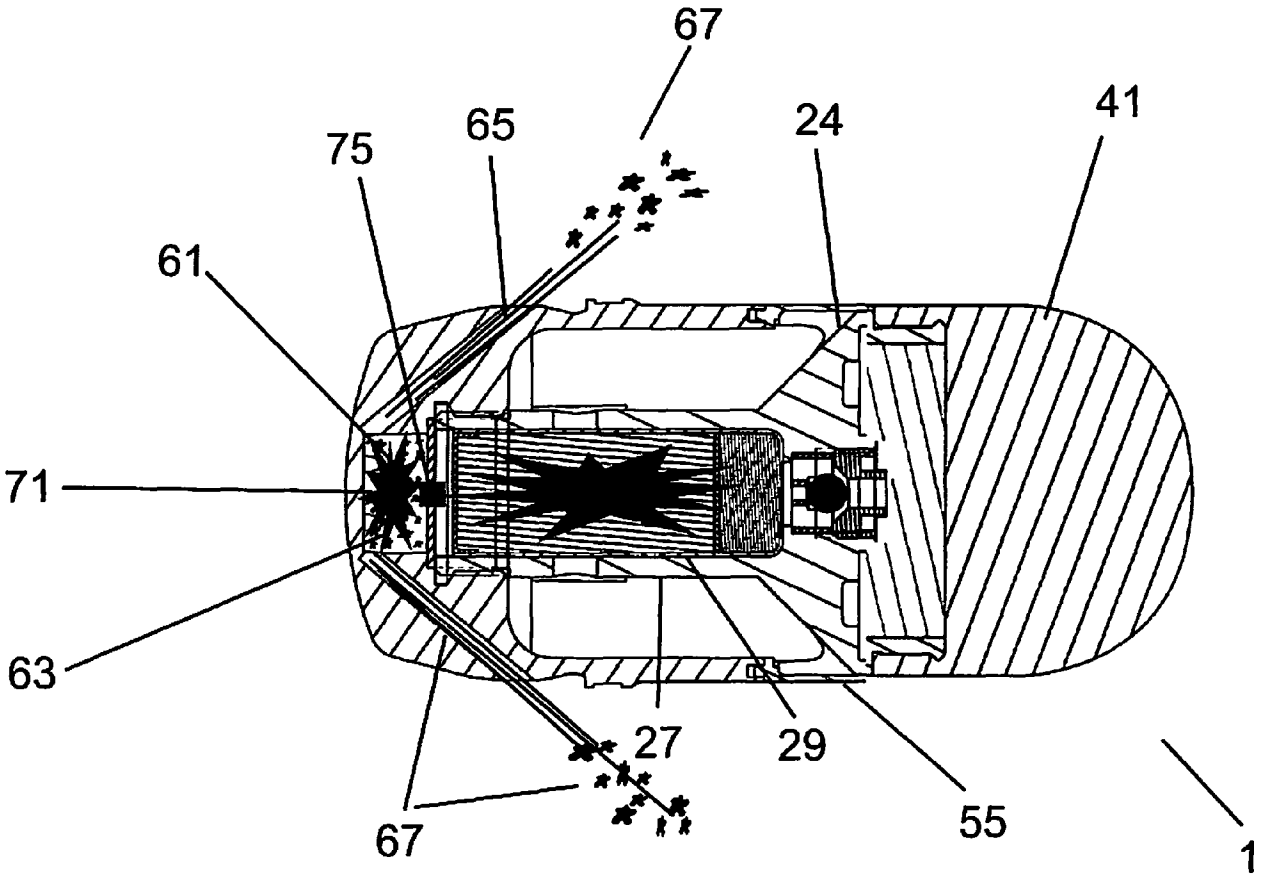
FIG. 14 is a cross sectional view of the projectile of the present invention, illustrating the projectile shown in FIG. 13 after firing thereof, and after the rear ballast has been expelled therefrom to decelerate the projectile.

The present inventors have found through experimental testing that some payloads do not have sufficient mass to provide a counterthrust strong enough to reduce velocity of the projectile to a non-lethal level. To address this issue, in a preferred embodiment of the present invention, as illustrated in FIG. 13, the projectile 1 is provided with a rear chamber 63 in communication with the hollow ignition shaft 27 via a rear chamber port 61. A ballast propellant 71 is be disposed within the rear chamber 63, as illustrated in FIG. 13 or 14, which is expelled to produce a reverse impulse to decelerate the projectile.

In such an embodiment, two or more rear chamber exhaust ports 65 are disposed within the projectile 1, extending from the rear chamber 63 to the circumferential portion 7 of the projectile body 3, so as to provide an opening from the rear chamber 63 to the exterior of the projectile. The rear ballast 67 is disposed within each of the chamber exhaust ports 65. This rear ballast 67 can be comprised of any suitable material to provide a rearward force upon being expelled. For example, metallic powder, such as tungsten or iron powder, may be used.

A rear piston 69 is disposed adjacent the rear ballast 67, so as to physically separate the rear ballast 67 from propellant 71 or 73, and provide an interface between expanding propellant gases and the ballast 67. As shown in FIG. 14, the ignition propellant 29 is initiated, thereby initiating the propellant 71 disposed within the rear chamber 63. High temperature propellant gases then quickly expand, forcing the rear pistons 69 forward within the rear chamber exhaust ports 65, thereby expelling the rear ballast 67 from the ports 65. This forward expulsion of ballast 67 creates a rearward thrust on the projectile 1, decelerating same.

Figure 15:
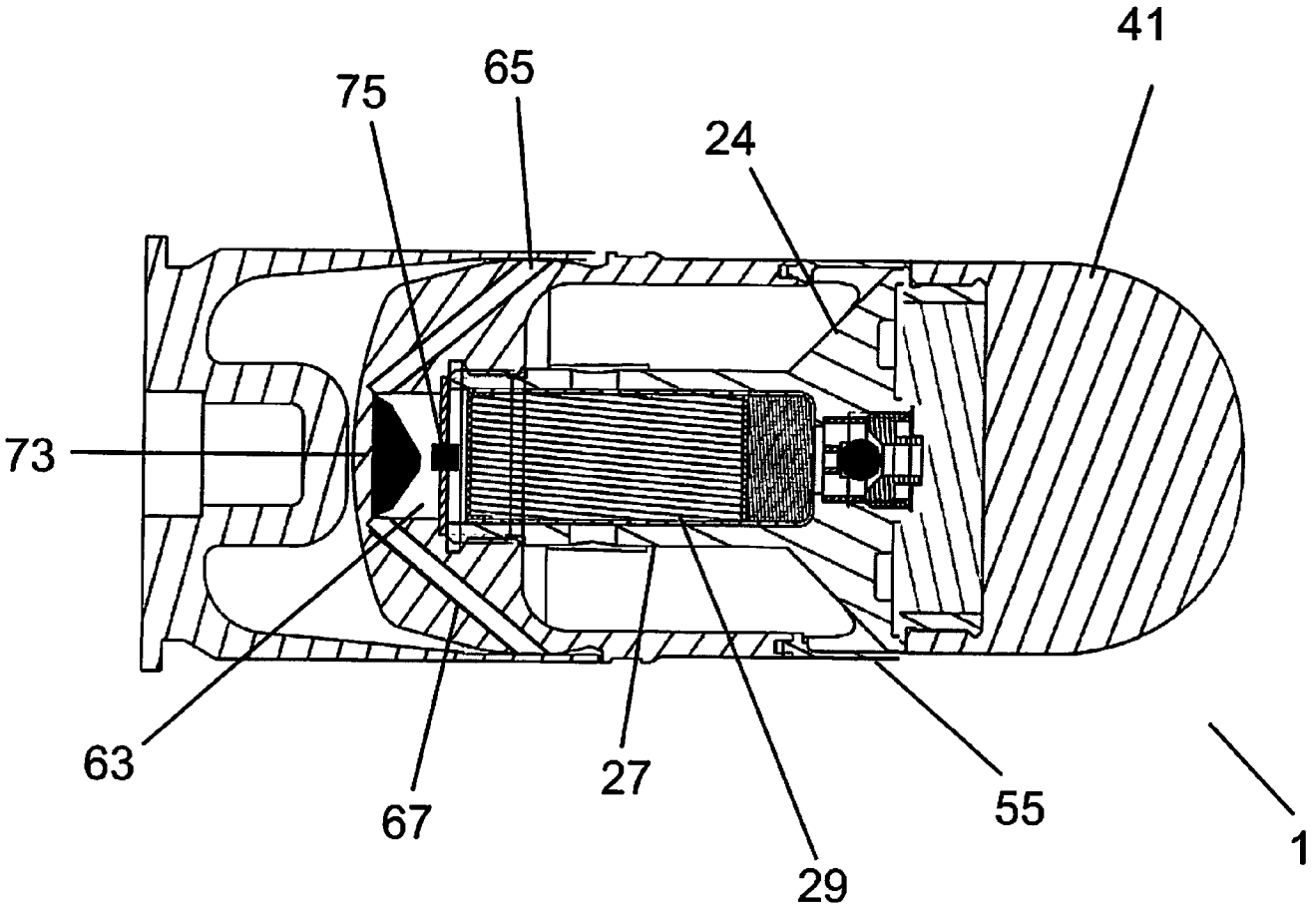
FIG. 15 is a cross sectional view of the projectile of the present invention, illustrating an embodiment wherein a rocket thrust is provided which, when initiated, exerts a reverse thrust to decelerate the projectile.
Figure 16:
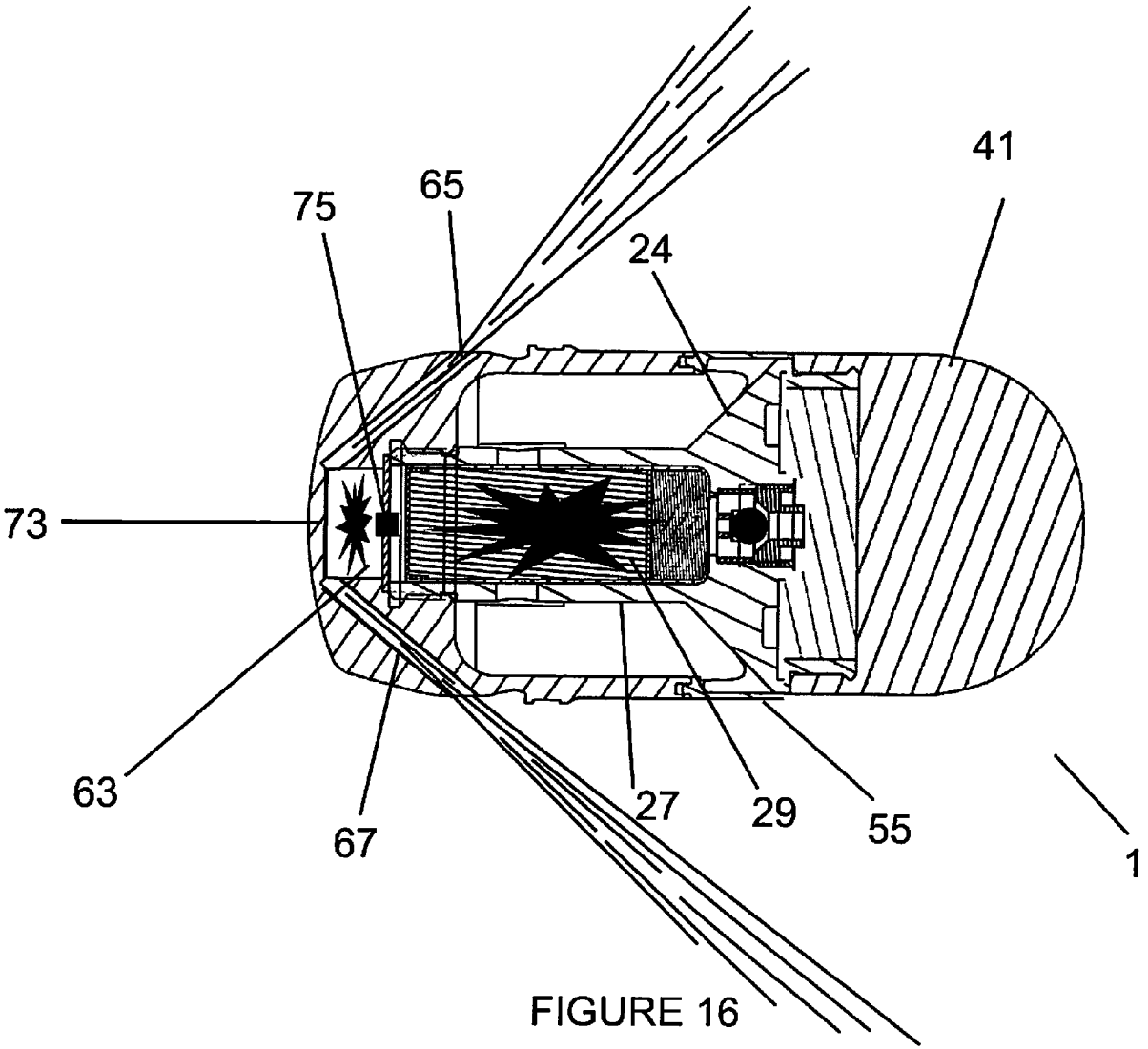
FIG. 16 is a cross sectional view of the projectile of the present invention, illustrating the projectile shown in FIG. 15 after firing thereof, and after the solid rocket propellant has been initiated.

As illustrated in FIGS. 15 and 16, in an alternative embodiment, a solid rocket propellant may be utilized to provide the decelerating reverse impulse effect, rather than the expulsion of a rear ballast. In particular, as illustrated in FIG. 15, a solid rocket propellant 73 is disposed within the rear chamber 63. The ignition propellant 29 is utilized to initiate the solid rocket propellant 73. As illustrated in FIG. 16, upon ignition of the solid rocket propellant 73, high temperature solid rocket propellant gases are expelled through the rear chamber exhaust ports 65, thereby producing a reverse impulse which decelerates the projectile.

In the embodiments of the present invention illustrated in FIGS. 13-16, in order to prevent the resultant high temperature propellant gases from expanding through the rear chamber port 61 and into the hollow ignition shaft 27, a rear check valve 75 is provided. As described above with relation to the check valve 53, the rear check valve 75 may be any conventional configuration of check valve able to permit flow in only one direction, while also being able to withstand high temperatures and pressures.

Although specific embodiments of the present invention have been disclosed herein, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

LIST OF DRAWING ELEMENTS

1: controlled deceleration projectile
3: hollow projectile body
4: partition
5: rear end of controlled deceleration projectile
7: circumferential portion of projectile
9: interior portion
11: front edge
24: angled exhaust surface
25: ignition shaft port
27: hollow ignition shaft
29: ignition propellant
31: first end of hollow ignition shaft
33: second end of hollow ignition shaft
35: hollow middle portion of hollow ignition shaft
37: ignition ports
38: expulsion propellant
39: payload
41: nose-mounted fuze
45: annular opening
50: string or line
51: payload cup
53: check valve
55: rupture ring
57: body stop
59: shear ring
61: rear chamber port
63: rear chamber
65: rear chamber exhaust ports
67: rear ballast
69: rear piston
71: ballast propellant
73: solid rocket propellant
75: rear check valve

What is claimed is:

1. A controlled deceleration projectile, comprising:

(a) a hollow projectile body having a rear end, a circumferential portion adjacent the rear end defining an interior portion, and a front edge opposite the rear end defined by the circumferential portion;

(b) an interior portion of the hollow projectile body defined by the circumferential portion and rear end of the hollow projectile body, said interior portion capable of containing a payload;

(c) a hollow ignition shaft disposed within the interior portion of the hollow projectile body, the hollow ignition shaft having a first end with an angled exhaust surface formed contiguous with the hollow ignition shaft adjacent the front edge of the hollow projectile body, a second end opposite the first end, a hollow middle portion disposed between first end and the second end having ignition ports disposed therethrough, and ignition propellant disposed within the hollow middle portion;

(d) ignition propellant disposed within the interior portion of the hollow projectile body, at least adjacent to the ignition ports of the hollow ignition shaft;

(e) a payload disposed within the interior portion;

(f) a nose-mounted fuze disposed adjacent the front edge of the hollow projectile body, and in communication with the ignition propellant disposed within the hollow ignition shaft, said nose-mounted fuze having a means for initiating the ignition propellant; and (g) a rupture ring disposed between the front edge of the hollow projectile body and the nose mounted fuze or first end of the hollow ignition shaft.

2. The controlled deceleration projectile of claim 1, further comprising:

(i) a rear chamber disposed within the hollow projectile body between the rear end of the hollow projectile body and the second end of the hollow ignition shaft;

(ii) a rear chamber port disposed within the hollow projectile body between the rear chamber and the second end of the hollow ignition shaft, so as to connect the hollow ignition shaft to the rear chamber; and (iii) two or more rear chamber exhaust ports, each of said exhaust ports being hollow, and extending from the rear chamber to the circumferential portion of the projectile, thereby providing a means of egress from the rear chamber to the exterior of the projectile.

3. The controlled deceleration projectile of claim 2, further comprising:

(i) a check valve disposed within or adjacent to the rear chamber port.

4. The controlled deceleration projectile of claim 2, further comprising:

(i) ballast propellant disposed within the rear chamber;

(ii) rear ballast disposed in each of said rear chamber exhaust ports; and (ii) a rear piston disposed in each of said rear chamber exhaust ports, between the rear ballast and the rear chamber.

5. The controlled deceleration projectile of claim 2, further comprising:

(i) solid rocket propellant disposed within the rear chamber.

6. A controlled deceleration projectile, comprising:

(a) a hollow projectile body having a rear end, a circumferential portion adjacent the rear end defining an interior portion, and a front edge opposite the rear end defined by the circumferential portion;

(b) an interior portion of the hollow projectile body defined by the circumferential portion and rear end of the hollow projectile body, said interior portion capable of containing a payload;

(c) a hollow ignition shaft disposed within the interior portion of the hollow projectile body, the hollow ignition shaft having a first end with an angled exhaust surface formed contiguous with the hollow ignition shaft adjacent the front edge of the hollow projectile body, a second end opposite the first end, a hollow middle portion disposed between first end and the second end having ignition ports disposed therethrough, and ignition propellant disposed within the hollow middle portion;

(d) ignition propellant disposed within the interior portion of the hollow projectile body, at least adjacent to the ignition ports of the hollow ignition shaft;

(e) a payload disposed within the interior portion;

(f) a nose-mounted fuze disposed adjacent the front edge of the hollow projectile body, and in communication with the ignition propellant disposed within the hollow ignition shaft, said nose-mounted fuze having a means for initiating the ignition propellant; and (g) a check valve disposed between the nose mounted fuze and the first end of the hollow ignition shaft.

7. A controlled deceleration projectile, comprising:

(a) a hollow projectile body having a rear end, a circumferential portion adjacent the rear end defining an interior portion, and a front edge opposite the rear end defined by the circumferential portion;

(b) an interior portion of the hollow projectile body defined by the circumferential portion and rear end of the hollow projectile body, said interior portion capable of containing a payload;

(c) a hollow ignition shaft disposed within the interior portion of the hollow projectile body, the hollow ignition shaft having a first end with an angled exhaust surface formed contiguous with the hollow ignition shaft adjacent the front edge of the hollow projectile body, a second end opposite the first end, a hollow middle portion disposed between first end and the second end having ignition ports disposed therethrough, and ignition propellant disposed within the hollow middle portion;

(d) ignition propellant disposed within the interior portion of the hollow projectile body, at least adjacent to the ignition ports of the hollow ignition shaft;

(e) a payload disposed within the interior portion;

(f) a nose-mounted fuze disposed adjacent the front edge of the hollow projectile body, and in communication with the ignition propellant disposed within the hollow ignition shaft, said nose-mounted fuze having a means for initiating the ignition propellant;

(g) expulsion propellant disposed within the interior portion of the hollow projectile body, adjacent the ignition ports of the hollow ignition shaft; and (h) at least one partition disposed within the interior portion of the hollow projectile body, wherein the at least one partition acts to physically separate the expulsion propellant from the payload.

* * * * *